US007805296B2

(12) United States Patent
Ichikawa et al.

(10) Patent No.: US 7,805,296 B2
(45) Date of Patent: Sep. 28, 2010

(54) AUDIO DATA PROCESSING DEVICE INCLUDING A JUDGMENT SECTION THAT JUDGES A LOAD CONDITION FOR AUDIO DATA TRANSMISSION

(75) Inventors: Tatsuya Ichikawa, Nagano-Ken (JP); Mahesh Inamdar, Nagano-Ken (JP); Anand Kumar, Nagano-Ken (JP); Aditya S. Chikodi, Nagano-Ken (JP); Kazuto Mogami, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 1371 days.

(21) Appl. No.: 11/259,127

(22) Filed: Oct. 27, 2005

(65) Prior Publication Data

US 2006/0092774 A1 May 4, 2006

(30) Foreign Application Priority Data

Oct. 28, 2004 (JP) ..... 2004-314289

(51) Int. Cl.
*G10L 19/14* (2006.01)

(52) U.S. Cl. ..... 704/225; 704/504; 700/94; 713/375; 381/104; 381/106; 381/107; 381/108; 708/172

(58) Field of Classification Search ..... 700/94; 704/225, 504; 713/375; 381/104, 106, 107, 381/108; 708/172
See application file for complete search history.

(56) References Cited

U.S. PATENT DOCUMENTS 4,947,454 A * 8/1990 Garner ..... 455/84
5,289,546 A * 2/1994 Hetherington ..... 381/104
5,673,362 A 9/1997 Matsumoto
5,761,643 A * 6/1998 Furuhashi ..... 704/504
5,784,602 A * 7/1998 Glass et al. ..... 712/220

(Continued)

FOREIGN PATENT DOCUMENTS

JP 2001-339682 A 12/2001

(Continued)

OTHER PUBLICATIONS

Yamada et al "Microprocessor-Assisted Audio Signal Processing System for VHS VCRS" 2001.*

(Continued)

*Primary Examiner*—Richemond Dorvil
*Assistant Examiner*—Greg A Borsetti
(74) *Attorney, Agent, or Firm*—Sughrue Mion, PLLC

(57) ABSTRACT

An audio data processing device including: a first processor; and a second processor which is connected to the first processor wherein the first processor includes: an audio data acquisition which acquires audio data of digital data; an omitting section which omits a bit corresponding to low volume which is hard to be heard by human ears from the audio data; and a transmitter which transmits the audio data in which the bit corresponding to the low volume is omitted by the omitting section from the first processor to the second processor; wherein the second processor includes: a receiver which receives the audio data transmitted from the first processor; and a reproduction data generator which generates audio reproduction data necessary to reproduce the audio data based on the received audio data.

11 Claims, 8 Drawing Sheets

U.S. PATENT DOCUMENTS

| | | | | |
|---|---|---|---|---|
| 5,794,068 | A * | 8/1998 | Asghar et al. | 712/35 |
| 5,809,466 | A * | 9/1998 | Hewitt et al. | 704/258 |
| 5,870,622 | A * | 2/1999 | Gulick et al. | 712/35 |
| 5,940,795 | A | 8/1999 | Matsumoto | |
| 5,940,796 | A | 8/1999 | Matsumoto | |
| 5,950,163 | A | 9/1999 | Matsumoto | |
| 6,043,837 | A * | 3/2000 | Driscoll et al. | 348/36 |
| 6,098,041 | A | 8/2000 | Matsumoto | |
| 6,179,489 | B1 * | 1/2001 | So et al. | 718/102 |
| 6,181,707 | B1 * | 1/2001 | Erickson et al. | 370/442 |
| 6,243,676 | B1 * | 6/2001 | Witteman | 704/243 |
| 6,266,425 | B1 * | 7/2001 | Fujisawa et al. | 381/120 |
| 6,298,370 | B1 * | 10/2001 | Tang et al. | 718/102 |
| 6,373,954 | B1 * | 4/2002 | Malcolm et al. | 381/119 |
| 6,446,037 | B1 * | 9/2002 | Fielder et al. | 704/229 |
| 6,628,999 | B1 * | 9/2003 | Klaas et al. | 700/94 |
| 6,662,060 | B1 * | 12/2003 | Maliszewski et al. | 700/94 |
| 7,337,026 | B2 * | 2/2008 | Lin | 700/94 |
| 2002/0071662 | A1 * | 6/2002 | Tatsumi et al. | 386/100 |
| 2003/0017808 | A1 * | 1/2003 | Adams | 455/76 |
| 2004/0093099 | A1 * | 5/2004 | Brennan | 700/94 |
| 2006/0088085 | A1 * | 4/2006 | Kelly et al. | 375/229 |

FOREIGN PATENT DOCUMENTS

| | | | |
|---|---|---|---|
| JP | 2002-189539 | A | 7/2002 |
| JP | 2003-202884 | A | 7/2003 |
| JP | 2004-260252 | A | 9/2004 |

OTHER PUBLICATIONS

Micronas UAC 355xB USB Codecs Data Sheet, May 2004.*

Stuart et al. "Self-Contained In-the-Ear Device to Deliver Altered Auditory Feedback: Applications for Stuttering" 2003.*

Lu et al. "An Efficient, Low Complexity Audio Coder Delivering Multiple Levels of Quality for Interactive Applications" 1998.*

"ESS Technology Introduces First Integrated Audio Chip with On-Chip Music Synthesis and Native Signal Processing Support." Mar. 1995.*

Quaglia et al. "Interactive DSP Educational Platform for Real-Time Subband Audio Coding" 2002.*

UAC 355xB Product information Feb. 2003.*

Jayant et al "Signal Compression Based on Models of Human Perception" 1993.*

Paulin et al. "Embedded Software in Real-Time Signal Processing Systems: Application and Architecture Trends" 1997.*

Krehnke et al. Technical Report, USB Audio Playback Peripheral (USB-APP) UDA1331H.1998.*

Deforeit et al. "A Music Synthesizer Architecture which Integrates a Specialized DSP Core and a 16-bit Microprocessor on a Single Chip" 1995.*

* cited by examiner

AUDIO DATA PROCESSING DEVICE INCLUDING A JUDGMENT SECTION THAT JUDGES A LOAD CONDITION FOR AUDIO DATA TRANSMISSION

CROSS REFERENCE TO RELATED APPLICATION

This application claims benefit of priority under 35 U.S.C.§119 to Japanese Patent Application No. 2004-314289, filed on Oct. 28, 2004, the entire contents of which are incorporated by reference herein.

BACKGROUND OF THE INVENTION

1. Field of the Invention

The present invention relates to an audio data processing device, and particularly relates to an audio data processing device including a first processor and a second processor.

2. Related Background Art

In a portable device, the operating time by a battery and heat generation are large problems. Usually, to avoid these problems, a low-power-consumption and low-heat-generation CPU is used in the portable device. Such a low-power-consumption and low-heat-generation CPU is more powerless than a CPU used in a personal computer. However, in such a powerless CPU, it is extremely difficult to perform highly loaded operations at the same time, for example, to display non-compressed images simultaneously while reproducing audio data.

Meanwhile, there is slide show application software used by installing a program in a personal computer. A slide show is a function of displaying plural images while switching the images at a predetermined timing, and in some cases the slide show additionally includes a function of simultaneously reproducing desired audio at a predetermined timing. In Japanese Patent Application Laid-open No. 2001-339682 and Japanese Patent Application Laid-open No. 2002-189539, a method of reproducing audio simultaneously while sequentially displaying plural digital images, which are photographed and stored by a digital camera alone, by a built-in display device is disclosed.

However, the simultaneous reproduction of images and audio imposes a large load on the CPU, and then heat is generated. In an image display device which is carried, heat generation hinders its carrying, function, which impairs user-friendliness. To prevent heat generation, an energy-saving and high-speed CPU is needed, but it costs a lot and thereby its commercialization is difficult.

Hence, there is a technique of distributing processes between the CPU and a DSP (Digital Signal Processor). However, the mere distribution of processes sometimes causes a delay to either the reproduction of images or the reproduction of audio. Namely, since respective processing load conditions of the images and the audio change every moment, in some cases, either of the CPU and the DSP which share the processes is temporarily brought into a high-load condition depending on the timing, which causes a waiting time until the high-load side process is completed.

In some cases, this results in non-smooth unnatural reproduction without the images being smoothly reproduced, or slow key response since processes other than those of images/audio are delayed. In a series of processes in the simultaneous reproduction of images and audio, an image file reading process and an audio reproduction process have specially high loads, whereby when these processes are overlapped, an image display process and the like are influenced.

On the other hand, there is a method of reducing the amount of data by cutting off high-frequency components, but this method is intended only to reduce the entire amount of data, and not intended to reduce the load on the CPU in a high-load condition in the distributed processes between the CPU and the DSP.

SUMMARY OF THE INVENTION

Hence, an object of the present invention is to provide an audio data processing device intended to reduce a load on a CPU (a first processor) when audio data is processed.

In order to accomplish the aforementioned and other objects, according to one aspect of the present invention, an audio data processing device, comprises:

a first processor; and a second processor which is connected to the first processor, wherein the first processor comprises:

an audio data acquisition which acquires audio data of digital data;

an omitting section which omits a bit corresponding to low volume which is hard to be heard by human ears from the audio data; and a transmitter which transmits the audio data in which the bit corresponding to the low volume is omitted by the omitting section from the first processor to the second processor;

wherein the second processor comprises:

a receiver which receives the audio data transmitted from the first processor; and a reproduction data generator which generates audio reproduction data necessary to reproduce the audio data based on the received audio data.

According to another aspect of the present invention, an audio data processing method of an audio data processing device including a first processor and a second processor, comprises the steps of:

acquiring audio data of digital data in the first processor;

omitting a bit corresponding to low volume which is hard to be heard by human ears from the audio data in the first processor;

transmitting the audio data in which the bit corresponding to the low volume is omitted from the first processor to the second processor;

receiving the audio data transmitted from the first processor in the second processor; and generating audio reproduction data necessary to reproduce the audio data based on the received audio data in the second processor.

According to a further aspect of the present invention, a recording medium comprises a program, which is recorded on the recording medium, the program causing an audio data processing device including a first processor and a second processor to process audio data, wherein the program causes the audio data processing device to execute the steps of:

acquiring audio data of digital data in the first processor;

omitting a bit corresponding to low volume which is hard to be heard by human ears from the audio data in the first processor;

transmitting the audio data in which the bit corresponding to the low volume is omitted from the first processor to the second processor;

receiving the audio data transmitted from the first processor in the second processor; and generating audio reproduction data necessary to reproduce the audio data based on the received audio data in the second processor.

DETAILED DESCRIPTION OF THE EMBODIMENTS

First Embodiment

An audio data processing device according to this embodiment is designed to reduce the processing time necessary for audio reproduction by making a DSP execute part of a process to be executed by a CPU out of processes necessary to reproduce audio based on audio data which is digital data and by omitting lower-order two bits which are hard to be heard by human hearing when the audio data is transferred from the CPU to the DSP. Further details will be given below.

Figure 1:
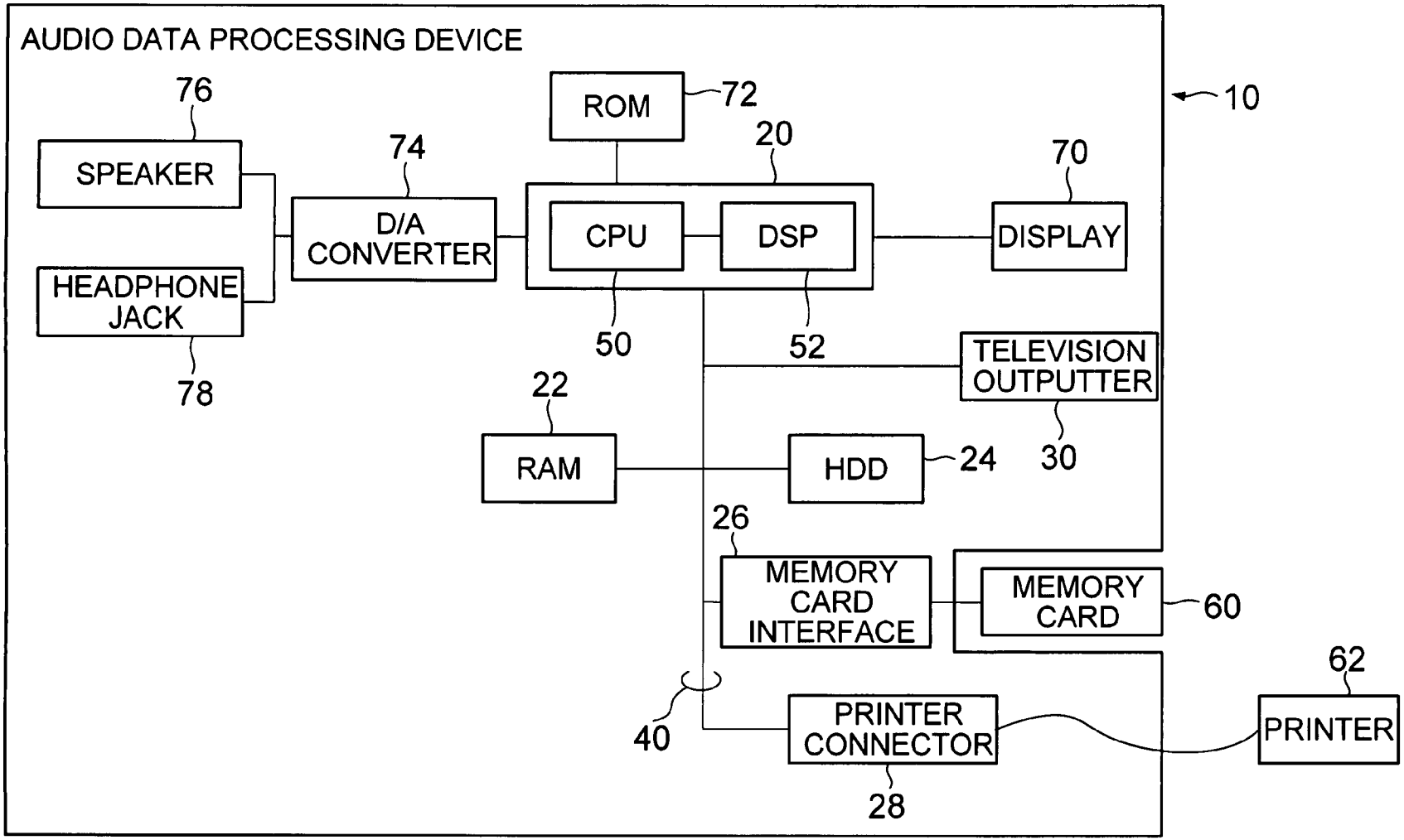
FIG. 1 is a diagram showing the internal configuration of an audio data processing device according to a first embodiment and a second embodiment, and a memory card and a printer which are connected thereto.

FIG. 1 is a block diagram showing an example of the internal configuration of an audio data processing device 10 according to this embodiment. In this embodiment, the audio data processing device 10 constitutes a portable image display device.

As shown in FIG. 1, the audio data processing device 10 according to this embodiment includes a processing unit 20, a RAM (Random Access Memory) 22, a hard disk drive 24, a memory card interface 26, a printer connector 28, and a television outputter 30, and they are interconnected via an internal bus 40.

The processing unit 20 includes a CPU (Central Processing Unit) 50 and a DSP (Digital Signal Processor) 52. In this embodiment, data is exchanged using bit lines of 16 bits between the CPU 50 and the DSP 52 (i.e. width in 16 bits). Further, in this embodiment, the number of bits processed by the CPU 50 is 32, and the number of bits processed by the DSP 52 is 16. Incidentally, in this embodiment, the CPU 50 and the DSP 52 are stored in one processing unit 20, but they may be stored in different units from each other.

The hard disk drive 24 is an example of a nonvolatile memory, and in this embodiment, for example, the hard disk drive 24 stores image data and audio data which are digital data. The audio data here is data obtained by digitalizing sound and voice, and includes music.

A memory card 60 is attached to the audio data processing device 10 as necessary, and various kinds of data stored in the memory card 60 are transferred to the hard disk drive 24 and the RAM 22 via the memory card interface 26, and conversely various kinds of data stored in these hard disk drive 24 and RAM 22 are transferred to the memory card 60.

A printer 62 is connected to the printer connector 28 as necessary. Therefore, the audio data processing device 10 according to this embodiment, for example, can print print data which is generated based on the image data stored in the hard disk drive 24 by the printer 62 by outputting it to the printer 62 via the printer connector 28.

The television outputter 30 can output television signals generated from the image data and the audio data to a home television set.

Further, a display 70, a ROM (Read Only Memory) 72, and a digital/analog converter 74 are connected to the aforementioned processing unit 20, and a speaker 76 and a headphone jack 78 are connected to the digital/analog converter 74.

The display 70 displays images reproduced based on the image data by the processing unit 20. The digital/analog converter 74 converts digital audio data outputted from the processing unit 20 into analog audio data and outputs it to the speaker 76 and the headphone jack 78.

Figure 2:
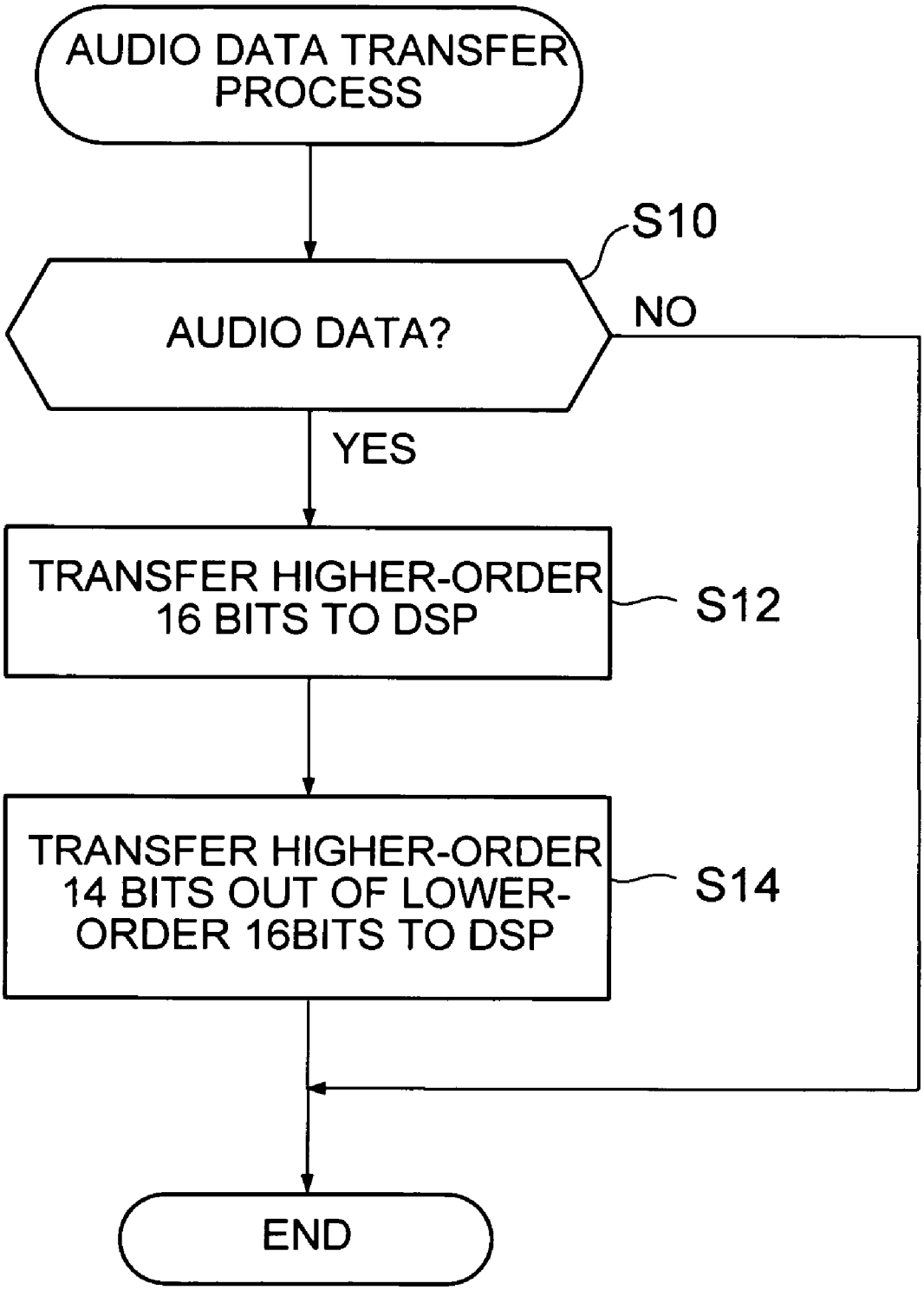
FIG. 2 is a flowchart describing the contents of an audio data transfer process according to the first embodiment.

Next, an audio data transfer process performed in the audio data processing device 10 according to this embodiment will be described based on FIG. 2. FIG. 2 is a flowchart describing the contents of the audio data transfer process. In this embodiment, this audio data transfer process is realized by making the CPU 50 read and execute an audio data transfer program stored in the hard disk drive 24. In this embodiment, this audio data transfer process is started when the CPU 50 acquires some data.

As shown in FIG. 2, first, the CPU 50 judges whether acquired data is audio data (step S10). When the acquired data is not the audio data (step S10: NO), the CPU 50 ends this audio data transfer process.

Figure 3:
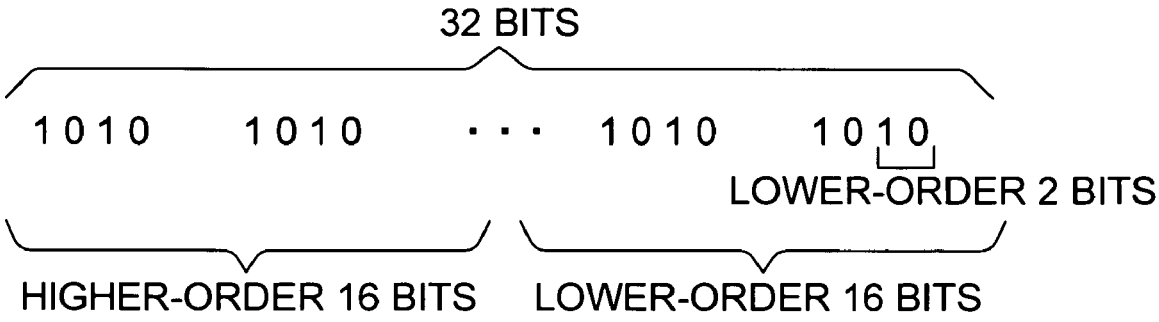
FIG. 3 is a diagram showing the bit configuration of 32-bit audio data.

On the other hand, when the acquired data is the audio data (step S10: YES), the CPU 50 transfers higher-order 16 bits of the audio data to the DSP 52 (step S12). Namely, in this embodiment, the audio data acquired by the CPU 50 is 32-bit digital data such as shown in FIG. 3. The CPU 50 transfers the higher-order 16 bits of the 32-bit digital audio data to the DSP 52. This is because between the CPU 50 and the DSP 52, data can be exchanged using the bit lines of 16 bits only.

Figure 4:
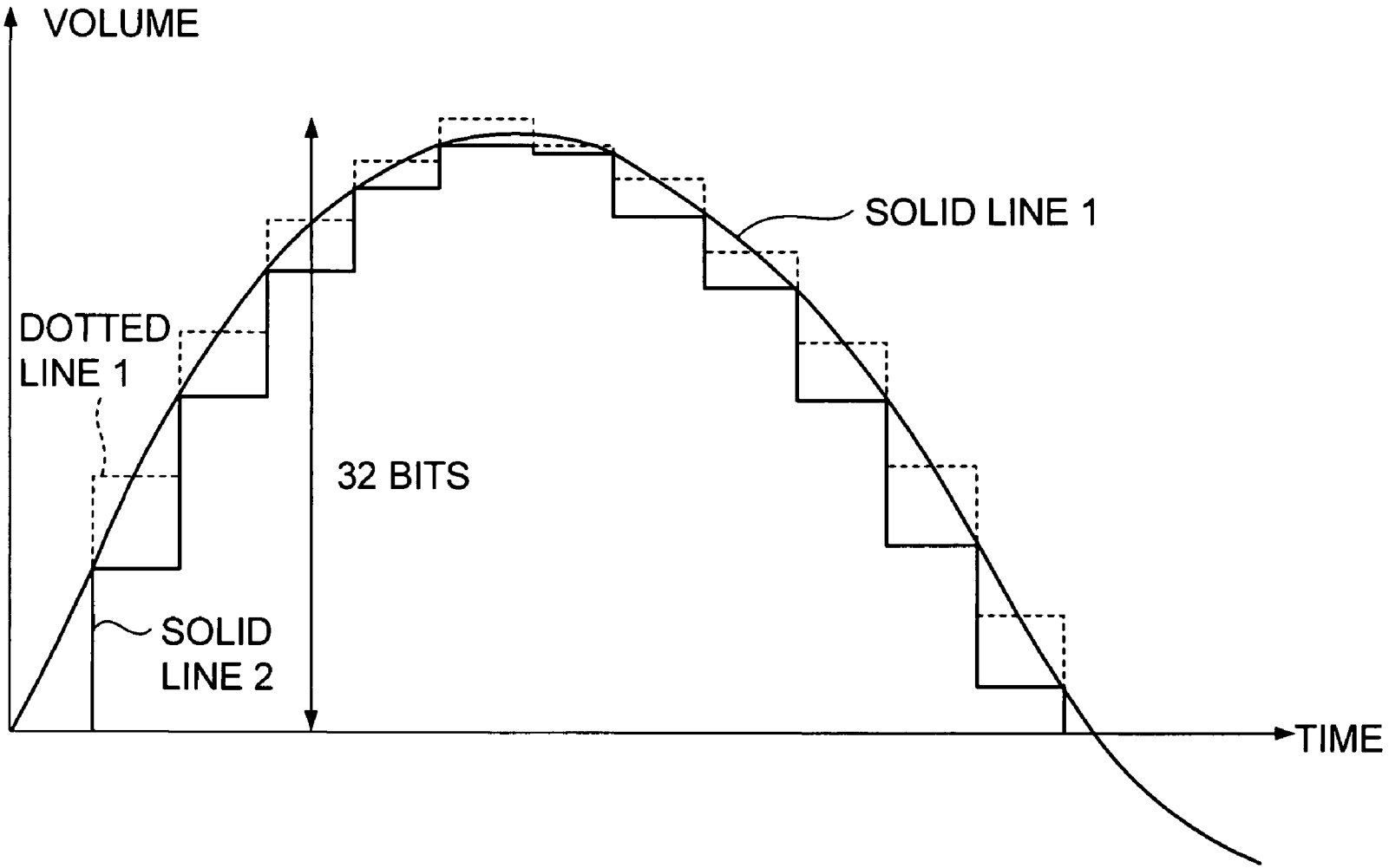
FIG. 4 is a diagram conceptually showing a waveform of audio to be reproduced and a waveform of audio reproduction data with respect to the waveform.

FIG. 4 shows a graph representing a waveform of the volume of the audio in this embodiment using a solid line 1. The data contents of the 32-bit audio data acquired by the CPU 50 will be explained using FIG. 4. The 32-bit audio data acquired by the CPU 50 represents information on the volume of audio at some point in time. Namely, the higher-order bit represents information on higher volume, and the lower-order bit represents information on lower volume.

Next, the CPU 50 transfers the higher-order 14-bit data in the lower-order 16 bits of the audio data to the DSP 52 (step S14). Namely, as shown in FIG. 3, the lower-order 2 bits are not transferred to the DSP 52. This is because, in this embodiment, the lower-order 2 bits of the audio data represent information on low volume which is hard to be heard by human ears, and therefore even if the lower-order 2 bits are omitted at the time of reproduction, the reproduced audio is not influenced very much. Moreover, by omitting the lower-order 2 bits, the time required to transfer the audio data can be reduced.

By the process in step S14, the audio data transfer process according to this embodiment is completed.

Figure 5:
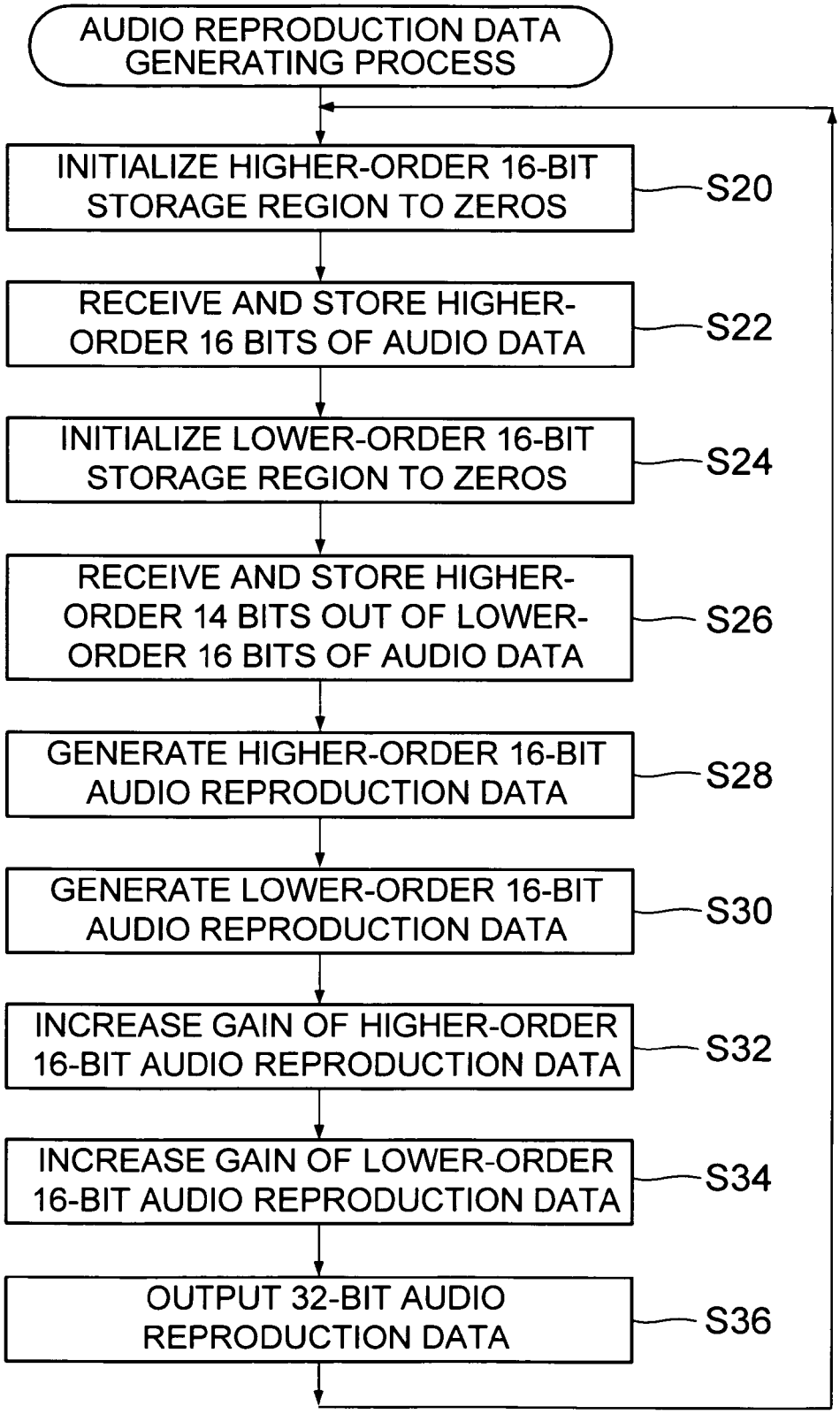
FIG. 5 is a flowchart describing the contents of an audio reproduction data generating process according to the first embodiment and the second embodiment.

FIG. 5 is a flowchart describing the contents of an audio reproduction data generating process executed by the DSP 52, corresponding to the aforementioned audio data transfer process. In this embodiment, this audio reproduction data generating process is realized by making the DSP 52 execute a program stored in a ROM included inside the DSP 52. In this embodiment, this audio reproduction data generating process is executed repeatedly as needed.

Figure 6:
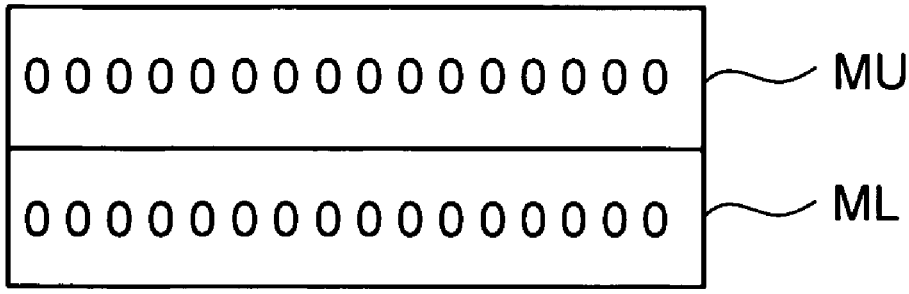
FIG. 6 is a diagram showing a higher-order 16-bit storage region and a lower-order 16-bit storage region which are formed in a memory of a DSP.

When the audio reproduction data generating process is started, first, the DSP 52 initializes a higher-order 16-bit storage region to zeros (step S20). FIG. 6 shows a higher-order 16-bit storage region MU and a lower-order 16-bit storage region ML which are formed in the memory included inside the DSP 52. In step S20, the higher-order 16-bit storage region MU is initialized, so that all 16 bits are set to zeros.

Then, the DSP 52 receives the higher-order 16 bits of the audio data from the CPU 50 and stores them in the higher-order 16-bit storage region MU (step S22).

Subsequently, the DPS 52 initializes the lower-order 16-bit storage region ML to zeros (step S24). Namely, the lower-order 16-bit storage region ML in FIG. 6 is initialized, so that all 16 bits are set to zeros.

Figure 7:
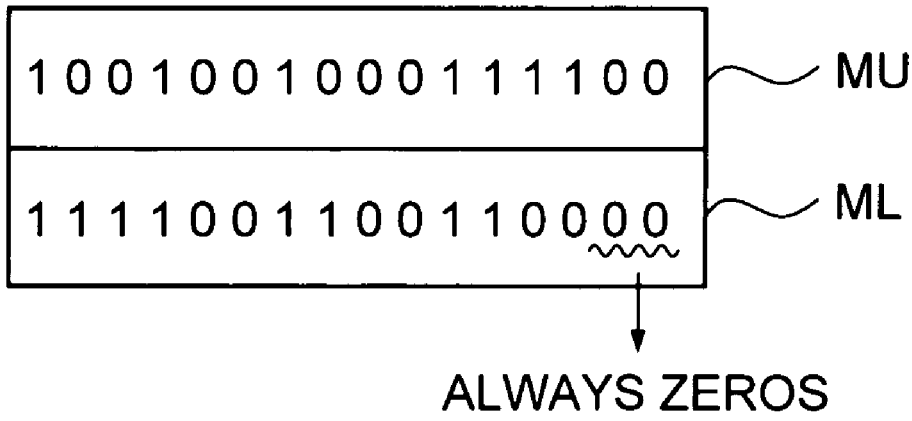
FIG. 7 is a diagram showing an example of audio data stored in the higher-order 16-bit storage region and the lower-order 16-bit storage region.

Thereafter, the DSP 52 receives the higher-order 14 bits in the lower-order 16 bits of the audio data from the CPU 50 and stores them in the lower-order 16-bit storage region ML (step S26). FIG. 7 shows an example of the states of the higher-order 16-bit storage region MU and the lower-order 16-bit storage region ML after step S26 is executed. Namely, the received higher-order 16-bit audio data is stored as it is in the higher-order 16-bit storage region MU. In a portion of the higher-order 14 bits of the lower-order 16-bit storage region ML, the received 14-bit audio data is stored as it is. The lower-order 2-bit audio data is omitted and not transmitted from the CPU 50, so that the lower-order 2 bits of the lower-order 16-bit storage region ML remain zeros. Namely, in this embodiment, the lower-order 2 bits of the lower-order 16-bit storage region ML are always zeros. In other words, in this embodiment, a process of compensating for the omitted 2 bits with zeros is performed.

Then, as shown in FIG. 5, the DSP 52 generates audio reproduction data for the higher-order 16 bits based on the digital data stored in the higher-order 16-bit storage region MU (step S28). Here, the audio reproduction data means digital data which becomes a base to generate analog audio.

Subsequently, the DSP 52 generates audio reproduction data for the lower-order 16 bits based on the digital data stored in the lower-order 16-bit storage region ML (step S30).

Thereafter, the DSP 52 performs a process of increasing the gain of the audio reproduction data for the higher-order 16 bits generated in step S28 (step S32). Then, the DSP 52 performs a process of increasing the gain of the audio reproduction data for the lower-order 16 bits generated in step S30 (step S34).

The gain of the audio reproduction data is increased in each of step S32 and step S34 for the following reason. As shown in FIG. 4, the audio data whose lower-order 2 bits are omitted means that since information on the lower-order 2 bits as information on low volume is zero, the volume becomes correspondingly lower. Accordingly, assuming that the waveform of the original volume is the solid line 1, it can be thought that such a waveform as a solid line 2 is obtained by omitting the lower-order 2 bits. Hence, in this embodiment, by increasing the gain of the audio reproduction data in each of step S32 and step S34, the solid line 2 is compensated to provide such a waveform as a dotted line 1. From this point of view, the processes in step S32 and step S34 can be omitted.

Then, the DSP 52 combines the 16-bit audio reproduction data whose gain is increased in step S32 and the 16-bit audio reproduction data whose gain is increased in step S34 to generate 32-bit audio reproduction data and outputs it to the digital/analog converter 74 (step S36). Namely, in this embodiment, the DSP 52 can perform data processing only on a 16 bits-by-16 bits basis, whereby the DSP 52 generates the 32-bit audio reproduction data at a final output stage, and outputs it to the digital/analog converter 74.

The digital/analog converter 74 which has received this audio reproduction data generates an analog audio signal based on the audio reproduction data and outputs it from the speaker 76 or outputs it to a headphone via the headphone jack 78.

After this step S36, the DSP 52 returns to the aforementioned step S20.

As described above, according to the audio data processing device 10 of this embodiment, after a bit (the lower-order 2 bits in this example) corresponding to the low volume which is hard to be heard by human ears is omitted from the audio data, the audio data is transferred from the CPU 50 to the DSP 52, which correspondingly can reduce the time required to transfer the audio data and also can shorten the processing time of the audio data in the DSP 52. Therefore, the processing time necessary to reproduce the audio data can be reduced as a whole. Moreover, as for the reproduction of the audio data, the distribution of the process thereof between the CPU 50 and the DSP 52 is made, which can reduce the processing load necessary to reproduce the audio data on the CPU 50.

Accordingly, for example, even when the audio data processing device 10 performs a slide show in which image data is continuously reproduced with the reproduction of the audio data, part of the process necessary to reproduce the audio data is performed by the DSP 52, whereby the load on the CPU 50 is correspondingly reduced, and consequently the CPU 50 can reproduce the image data smoothly.

Namely, if the CPU 50 performs all of the reproduction of the image data and the reproduction of the audio data when the audio data processing device 10 reproduces the audio data simultaneously in the slide show, the reproduction process is sometimes delayed. Hence, in this embodiment, a predetermined part of the reproduction process of the audio data is executed on the DSP 52 side. This makes it possible to reduce the load on the CPU 50 and complete the reproduction of the image data within a fixed period of time.

However, in this embodiment, although the audio data in the CPU 50 is 32-bit data, the DSP 52 processes data on a 16 bits-by-16 bits basis. Therefore, data is transmitted from the CPU 50 to the DSP 52 on a 16 bits-by-16 bits basis. Accordingly, the need for dividing the 32-bit audio data to transmit 16 bits twice from the CPU 50 to the DSP 52 arises. However, if 16-bit audio data is transmitted twice and subjected to the reproduction process in the DSP 52, the reproduction process of the audio data gets delayed.

Hence, in this embodiment, by transmitting the audio data from the CPU 50 to the DSP 52 after omitting the lower-order 2 bits as the information on low volume which is hard to be heard by human ears, the time of transmission to the DSP 52 and the reproduction time in the DSP 52 are reduced, whereby the reproduction of the audio data is completed by a predetermined fixed time.

As a result, even if the CPU 50 is a low-power-consumption and low-heat-generation powerless CPU, a user can enjoy the slide show with audio without undergoing any stress.

Second Embodiment

By modifying the aforementioned first embodiment, the second embodiment is designed in such a manner that the audio data is reproduced by the CPU 50 when the load on the CPU 50 is not high.

Figure 8:
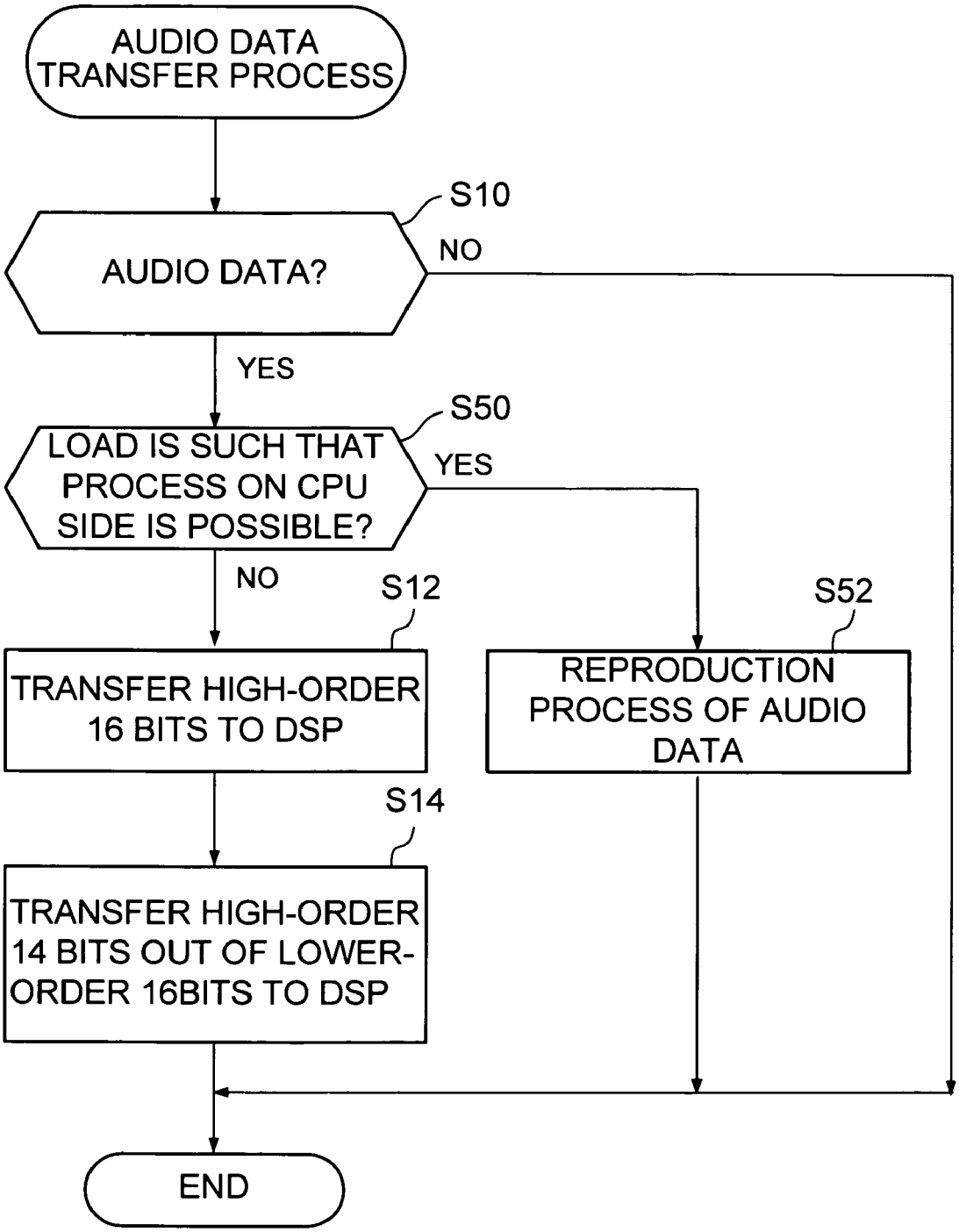
FIG. 8 is a flowchart describing the contents of an audio data transfer process according to the second embodiment.

FIG. 8 is a flowchart describing the contents of an audio data transfer process according to this embodiment, and corresponds to FIG. 2 in the aforementioned first embodiment.

As shown in FIG. 8, in this embodiment, when the acquired data is the audio data (step S10: YES), the CPU 50 checks the load condition of the CPU 50 at this point of time and judges whether the load is such that the audio data can be reproduced on the CPU 50 side (step S50).

When judging that the audio data can be reproduced by the CPU 50 since the load on the CPU 50 is low (step S50: YES), the CPU 50 itself performs the process necessary to reproduce the audio data (step S52). Namely, the process performed on the DSP 52 side in the aforementioned first embodiment is performed on the CPU 50 side.

In contrast, when judging in step S50 that the audio data cannot be reproduced by the CPU 50 side since the load on the CPU 50 is high (step S50: NO), the CPU 50 transfers the audio data to the DSP 52 (step S12, step S14) as in the aforementioned first embodiment.

Respects other than this are the same as in the aforementioned first embodiment, and hence a description thereof will be omitted.

When the load on the CPU 50 is checked and the audio data can be reproduced on the CPU 50 side as described above, all the processes may be performed on the CPU 50 side without load distribution between the CPU 50 and the DSP 52.

It should be mentioned that the present invention is not limited to the aforementioned embodiments, and various changes may be made therein. For example, in the aforementioned embodiments, the CPU 50 is shown as an example of the first processor, and the DSP 52 is shown as an example of the second processor, but the present invention is also applicable to a case where other kinds of processors are used. Moreover, the audio data processing device 10 may include plural, two or more, processors.

Further, in the aforementioned embodiments, the audio data is compressed in some cases, and when the audio data is compressed, high-frequency components thereof are sometimes omitted. When the high-frequency components are cut off as just described, the entire amount of data is reduced, but a reduction in the load on the CPU in the distributed process between the CPU 50 and the DSP 52 is not intended. Therefore, it is effective to apply the present invention to the audio data whose high-frequency components are cut off to reduce the load on the CPU 50. In other words, it can be said that reducing the entire data amount by cutting off the high-frequency components and reducing the load on the CPU 50 when the audio data is reproduced are essentially different.

Furthermore, the aforementioned embodiments are explained with the case where the audio data processing device 10 is the portable small-sized image display device as an example, but the present invention is also applicable to other devices which need reproduction of the audio data.

As concerns the respective processes explained in the aforementioned embodiments, it is possible to record a program to execute each of these processes on a recording medium such as a flexible disk, a CD-ROM (Compact Disc-Read Only Memory), a ROM, a memory card, or the like and distribute this program in the form of the recording medium. In this case, the aforementioned embodiments can be realized by making the audio data processing device 10 read and execute the program recorded on the recording medium.

Furthermore, the audio data processing device 10 sometimes has other programs such as an operating system, other application programs, and the like. In this case, to utilize these other programs in the audio data processing device 10, a program including a command, which calls a program to realize a process equal to that in the aforementioned embodiments out of the programs in the image display device 10, may be recorded on the recording medium.

Moreover, such a program can be distributed not in the form of the recording medium but in the form of a carrier wave via a network. The program transmitted in the form of the carrier wave over the network is incorporated in the audio data processing device 10, and the aforementioned embodiments can be realized by executing this program.

Further, when being recorded on the recording medium or transmitted as the carrier wave over the network, the program is sometimes encrypted or compressed. In this case, the audio data processing device 10 which has read the program from the recording medium or the carrier wave needs to execute the program after decrypting or expanding the program.

Figure 9:
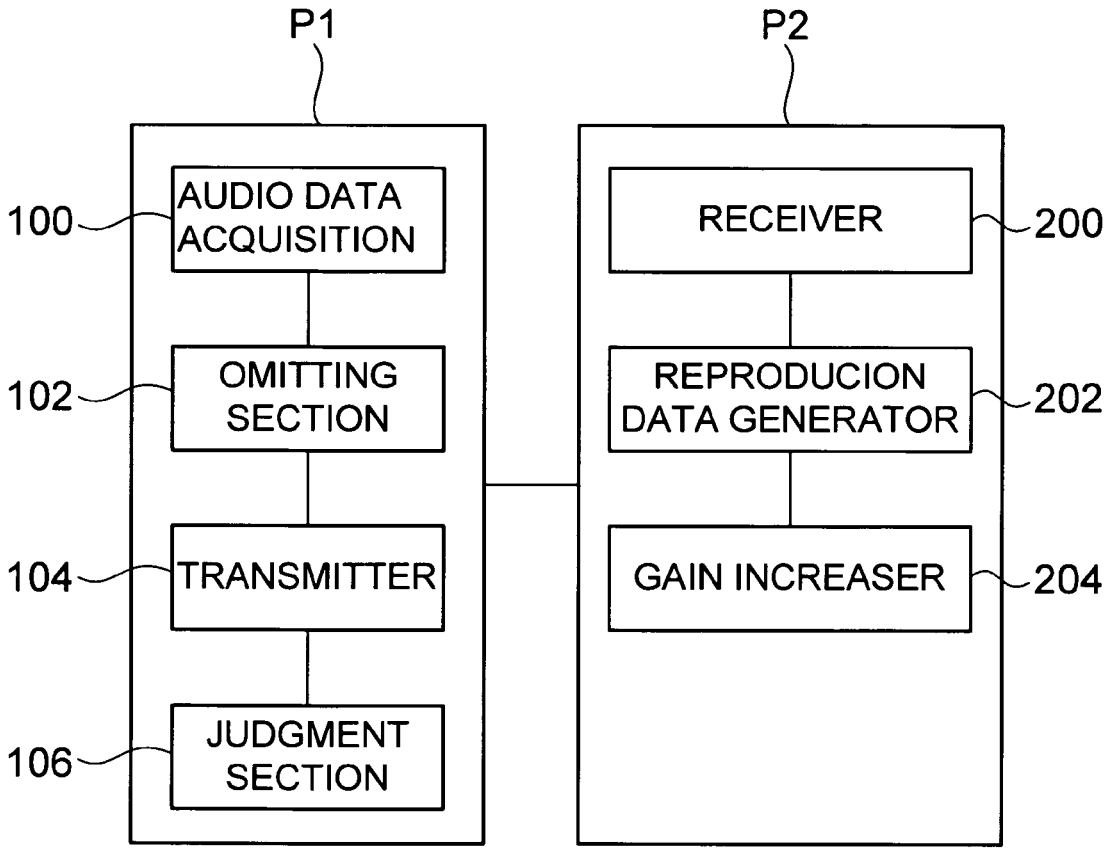
FIG. 9 is a block diagram showing an example of the internal configuration of a first processor and a second processor when the audio data transfer process and the audio reproduction data generating process are realized by hardware.

Moreover, the audio data transfer process and the audio reproduction data generating process are realized by software in the above-mentioned embodiments, but they may be realized by hardware. FIG. 9 shows an example of a hardware structure in which the audio data transfer process and the audio reproduction data generating process are realized by the hardware. FIG. 9 depicts only a first processor P1 and a second processor P2, but structure other than the first processor P1 and the second processor P2 is the same manner as the first embodiment and the second embodiment.

As shown in FIG. 9, the first processor P1 corresponds to the CPU 50, and the first processor P1 includes an audio data acquisition 100, an omitting section 102 and a transmitter 104. In addition, the second processor P2 corresponds to the DSP 52, and the second processor P2 includes a receiver 200 and a reproduction data generator 202. Moreover, the first processor P1 may include a judgment section 106, and the second processor P2 may include a gain increaser 204.

The audio data acquisition 100 acquires audio data of digital data. For example, the audio data is acquired from the hard disk drive 24 or the memory card 60. The omitting section 102 omits a bit corresponding to low volume which is hard to be heard by human ears from the audio data. In the above-mentioned embodiments, the lower-order 2-bit of the audio data is omitted. The transmitter 104 transmits the audio data in which the bit is omitted by the omitting section 102 from the first processor P1 to the second processor P2.

The receiver 200 in the second processor P2 receives the audio data transmitted from the first processor P1. The reproduction data generator 202 generates audio reproduction data necessary to reproduce the audio data based on the received audio data.

In this case, the reproduction data generator 202 may generate the audio reproduction data by compensating the received data for the omitted bit. Specifically, the reproduction data generator 202 may compensate for the omitted bit with a zero.

In addition, the gain increaser 204 may increase a gain of the audio reproduction data generated by the reproduction data generator 202.

The judgment section 106 checks a load condition of the first processor P1 and judges whether a load is such that the audio reproduction data can be generated by the first processor P1. When the judgment section 106 judges that the load condition of the first processor P1 is such a load condition that the audio reproduction data can be generated by the first processor P1, the transmitter 104 does not transmit the audio data to the second processor P2. In this case, the first processor P1 generates the audio reproduction data.

Process and structure other than that mentioned above are in the same manner as the first embodiment or the second embodiment.

What is claimed is:

1. An audio data processing device, comprising:

a first processor; and a second processor which, is connected to the first processor, wherein the first processor comprises:

an audio data acquisition which acquires audio data of digital data;

an omitting section which omits a bit corresponding to low volume which is hard to be heard by human ears from the audio data;

a transmitter which transmits the audio data in which the bit corresponding to the low volume is omitted by the omitting section from the first processor to the second processor; and a judgment section which checks a load condition of the first processor and judges whether a load is such that the audio reproduction data can be generated by the first processor, wherein when the judgment section judges that the load condition of the first processor is such a load condition that the audio reproduction data can be generated by the first processor, the transmitter does not transmit the audio data to the second processor; and when the judgment section judges that the load condition of the first processor is such a load condition that the audio reproduction data can not be generated by the first processor, the transmitter transmits the audio data to the second processor;

wherein the second processor comprises:

a receiver which receives the audio data transmitted from the first processor; and a reproduction data generator which generates audio reproduction data necessary to reproduce the audio data based on the received audio data;

wherein each bit of the audio data represents information on volume;

wherein the reproduction data generator generates the audio reproduction data by compensating the received audio data for the omitted bit.

2. The audio data processing device according to claim 1, wherein the reproduction data generator compensates for the omitted bit with a zero.

3. The audio data processing device according to claim 2, wherein the second processor further comprises a gain increaser which increases a gain of the audio reproduction data generated by the reproduction data generator.

4. The audio data processing device according to claim 3, wherein the number of bit lines to transmit data from the first processor to the second processor is smaller than the number of bits of the audio data acquired by the audio data acquisition.

5. The audio data processing device according to claim 4, wherein the number of bits processed by the second processor is smaller than the number of bits processed by the first processor.

6. An audio data processing method of an audio data processing device including a first processor and a second processor, comprising the steps of:

acquiring audio data of digital data in the first processor;

omitting a bit corresponding to low volume which is hard to be heard by human ears from the audio data in the first processor;

transmitting the audio data in which the bit corresponding to the low volume is omitted from the first processor to the second processor and checking a load condition of the first processor and judging whether a load is such that the audio reproduction data can be generated by the first processor;

wherein when it is judged that the load condition of the first processor is such a load condition that the audio reproduction data can be generated by the first processor, the audio data is not transmitted to the second processor in the step of transmitting the audio data; and wherein when it is judged that the load condition of the first processor is such a load condition that the audio reproduction data can be generated by the first processor, the audio data is not transmitted to the second processor in the step of transmitting the audio data; and receiving the audio data transmitted from the first processor in the second processor; and generating audio reproduction data necessary to reproduce the audio data based on the received audio data in the second processor;

wherein each bit of the audio data represents information on volume;

wherein, in the step of generating the audio reproduction data, the audio reproduction data is generated by compensating the received audio data for the omitted bit.

7. The audio data processing device according to claim 1, wherein, in the step of generating the audio reproduction data, the received audio data is compensated for the omitted bit with a zero.

8. The audio data processing method according to claim 7, further comprising the step of increasing a gain of the generated audio reproduction data.

9. The audio data processing method according to claim 8, wherein the number of bit lines to transmit data from the first processor to the second processor is smaller than the number of bits of the audio data acquired in the first processor.

10. The audio data processing method according to claim 9, wherein the number of bits processed by the second processor is smaller than the number of bits processed by the first processor.

11. A recording medium comprising a program, which is recorded on the recording medium, the program causing an audio data processing device including a first processor and a second processor to process audio data, wherein the program causes the audio data processing device to execute the steps of:

acquiring audio data of digital data in the first processor;

omitting a bit corresponding to low volume which is hard to be heard by human ears from the audio data in the first processor;

transmitting the audio data in which the bit corresponding to the low volume is omitted from the first processor to the second processor and checking a load condition of the first processor and judging whether a load is such that the audio reproduction data can be generated by the first processor, wherein when it is judged that the load condition of the first processor is such a load condition that the audio reproduction data can be generated by the first processor, the audio data is not transmitted to the second processor in the step of transmitting the audio data; and wherein when it is judged that the load condition of the first processor is such a load condition that the audio reproduction data can not be generated by the first processor, the audio data is transmitted to the second processor in the step of transmitting the audio data;

receiving the audio data transmitted from the first processor in the second processor; and generating audio reproduction data necessary to reproduce the audio data based on the received audio data in the second processor;

wherein each bit of the audio data represents information on volume;

wherein, in the step of generating the audio reproduction data, the audio reproduction data is generated by compensating the received audio data for the omitted bit.

* * * * *